US006022203A

United States Patent [19]

Kirsten

[11] Patent Number: 6,022,203

[45] Date of Patent: Feb. 8, 2000

[54] VARIABLE-DISPLACEMENT SCREW-TYPE COMPRESSOR

[76] Inventor: Guenter Kirsten, Erzbergerstrasse 13, D-08451, Crimmitschau, Germany

[21] Appl. No.: 08/952,739

[22] PCT Filed: May 15, 1996

[86] PCT No.: PCT/EP96/02077

§ 371 Date: Nov. 25, 1997

§ 102(e) Date: Nov. 25, 1997

[87] PCT Pub. No.: WO96/38670

PCT Pub. Date: Dec. 5, 1996

[30] Foreign Application Priority Data

May 31, 1995 [DE] Germany ..... 195 19 262

[51] Int. Cl.[7] ..... F04C 18/16; F04C 29/08

[52] U.S. Cl. ..... 418/201.2; 417/440

[58] Field of Search ..... 418/201.2; 417/440

[56] References Cited

U.S. PATENT DOCUMENTS 3,151,806 10/1964 Whitfield ..... 418/201.2

4,453,900 6/1984 Schibbye et al. ..... 418/99

4,597,726 7/1986 Soderlund et al. ..... 418/201.2

5,203,683 4/1993 Yoshikawa et al. ..... 417/440

FOREIGN PATENT DOCUMENTS 2526 175 6/1975 Germany .

3516 636 5/1985 Germany .

*Primary Examiner*—John J. Vrablik

*Attorney, Agent, or Firm*—Diller, Ramik & Wight, PC

[57] ABSTRACT

The invention relates to a variable-displacement screw-type compressor with at least one main rotor and at least one subsidiary rotor which are fitted in the same housing, mesh together and convey a medium to be compressed from an inlet to an outlet, in which the inlet is bounded by at least one housing segment fitted to slide in the housing which follows the shape of the rotor casings on its sealing side facing the rotors. At least one housing segment is guided and movable transversely to the rotor axes.

13 Claims, 7 Drawing Sheets

60
62
20
10
12
36
A
28
26
A
56
62
46
36
66
80
B
48
82
76
78
34
98
96
68
70
72
88
74
84
100
86

60

12
62
20
10
28
26
48
96
80
82
76
78
68
70
34
74
72
38
88

VARIABLE-DISPLACEMENT SCREW-TYPE COMPRESSOR

TITLE OF THE INVENTION

BACKGROUND OF THE INVENTION

The invention refers to a variable displacement screw-type compressor.

In installations using a compressed medium as the pressure gas, it is often necessary to regulate the pressure prevailing in the installation. This is either done by bleeding a certain amount of pressure from the installation or returning it via the bypass, or by changing the feed rate of the pressure gas.

If the compressor used in such an installation is a screw-type compressor, the feed rate may be adjusted by changing the number of rotations of the screw-type compressor. However, this adjustment has its limit where too small numbers of rotation of the screw-type compressor cause the efficiency of the screw-type compressor to fall below an acceptable value.

Since the bleeding and the bypassing of the pressure gas cause unacceptable energy consumption, anyway, and, on the other hand, a broad adjustment range is imperative, screw-type compressors have been developed, in which the feed rate provided by the screw-type compressor can be adjusted by the compression ratio of the screw-type compressor.

DE-05 25 26 175 shows a screw-type compressor with a variable volumetric capacity, wherein two meshing rotors are arranged in a housing. In this screw-type compressor, a return flow channel extends in parallel to the rotor axes of the screw-type compressor, which channel may be communicated with the interior of the housing through closable openings. In the open state, the openings spaced in the axial direction of the rotors allow for a return flow of the medium to be compressed through the return flow channel to the intake side of the screw-type compressor. Thereby, the compression of the medium flown in between the screws and the inner wall of the housing starts sooner or later, depending on the opening state of the openings so that the feed rate provided by this screw-type compressor is variable. However, the openings, the ends of which at the overflow channel side may be closed by means of a control piston, are also open towards the interior of the housing when in their closed state, whereby they form overflow pockets that cause a return flow of the medium to be compressed even at a delivery volume of 100%. Therefore, the screw-type compressor has a poor efficiency.

DE-PS 35 16 636 on which the precharacterizing part of claim 1 is based, discloses another variable displacement screw-type compressor. In the same, a primary and a secondary rotor are provided in a housing. In this screw-type compressor, the medium to be compressed is conveyed from an inlet channel to an outlet channel, the inlet channel having two housing segments displaceable along the rotor axes. The housing segments each extend in the housing over the entire rotor length and are floatingly supported at one end. The pressures occurring transversely to the longitudinal extension of the housing segments and being received through guiding paths, however, cause bending loads on the housing segments. In operation, displacing the housing segments towards the outlet channel causes a channel wall defining the inlet channel to be displaced such that the inlet channel is prolonged and the compression starts later. Due to the later start of the compression, the compression ratio, and thereby the feed rate of the screw-type compressor, is modified.

To make even small changes in the displaced volume, it is necessary to displace the respective entire housing segment extending over the full rotor length. The unilaterally floating support of the housing segments necessary therefor, however, has the disadvantage of a high production effort. Further, the control segments that extend through the pressure side of the screw-type compressor are induced to vibrate by the high pulsating pressures prevailing at the pressure side of the screw-type compressor, the vibrations causing the guiding paths to become unsteady. Finally, it is another disadvantage that the housing segments cause a great structural length of the screw-type compressor and impose a limit to the freedom of structural design on the pressure side of the screw-type compressor.

SUMMARY OF THE INVENTION

It is an object of the invention to provide a variable displacement screw-type compressor that can be operated with little wear, has a high efficiency and is convenient to produce.

The object is solved, according to the invention, with the features of claim 1.

According to the invention, the at least one housing segment is guided in a well of the housing to slide transversely to the rotor axes. Since the pressure acting on each housing segment causes a resultant pressure force effective almost in parallel to the direction of displacement of the housing segment, the bearings of the housing segments are loaded only to a small extent. This not only leads to a reduced wear of the screw-type compressor, but also to a facilitated production thereof, since one may omit a complex support of the housing segment. Since each housing segment has its sealing side facing the rotors formed with a geometry following the course of the envelope of the rotors and since these sealing sides can always be positioned precisely, the screw-type compressor has a high efficiency.

The slidableness of the housing segment transversal to the rotor axes also provides for a short structural length and the freedom in constructing the front ends of screw-type compressors is increased. Thus, transversely slidable housing segments can therefore be well implemented in twin screw compressors.

In order to adjust a multi-stage adjustment of the feed rate, a plurality of housing segments are arranged in succession in the axial direction of the rotors. Preferably, each housing segment has a length in the axial direction of the rotors that corresponds to the axial distance of the contact points of two meshing pairs of teeth. Since the compression only starts when a compression chamber formed by the tooth flanks and the inner housing wall is closed, a finer and, due to the higher production effort, a smaller gradation by means of housing segments is not necessary. Nevertheless, a fine adjustment of the displacement rate may be obtained in housing segments of this design by displacing one housing segment more or less so that the inlet channel shows a throttle effect regardless of its effective length.

If the width of each housing segment transverse to the axial direction of the rotors is dimensioned such that the change in the inlet channel volume caused by the displacement of each housing segment corresponds to the volume of a compression chamber defined by two tooth flanks of the rotors, throttle effects causing an unfavorable efficiency, can be avoided by adjusting the feed rate in correspondence to the discrete gradations of the rotor. It is true, as described above that throttle effects may be desirable for obtaining a continuous band width of feed rates, however, these shall only occur when they are set intentionally.

By providing each housing segment with two stop surfaces that limit the movability of the housing segments towards the rotors and may preferably abut against two abutment surfaces extending in parallel to the well, it is achieved that the distance of the housing segments to the rotors can be observed precisely. Precisely maintaining the distance between the housing segments and the rotors guarantees a high efficiency.

Preferably, the housing segments are biased by means of springs so that single action actuators (acting in one direction) suffice to displace the housing segments. Preferably, such actuators are control cams arranged on a common cam shaft and displacing the housing segments. A displacement by control cams is not only cost-effective, but moreover guarantees that the position of all housing segments that determine the geometry of the inlet channel can be adjusted with precise coordination. Further, the control cams make it possible to move at least one of the housing segments into a position in which it acts as a throttle arranged in the inlet channel. When the springs are biased such that they force the housing segments into their raised position, in which they bound the feed channel, the precise observation of the closing position of the housing segments is independent from the wear of the control cams. Moreover, in this structure, the bias forces of the springs counteract the pressure forces of the compressed gas so that the respective necessary force to be applied by the control cams to move the housing segments is low.

Other actuators than the control cams can be provided for moving the housing segments, for example fluid-operated adjustment cylinders that may also be double action cylinders, whereby the provision of bias springs is obsolete.

Further advantageous embodiments and developments of the invention result from the dependent claims, as well as from the description taken in conjunction with the drawings. The following is a description of the invention with reference to two preferred embodiments.

DESCRIPTION OF THE PREFERRED EMBODIMENTS

Figure 1:
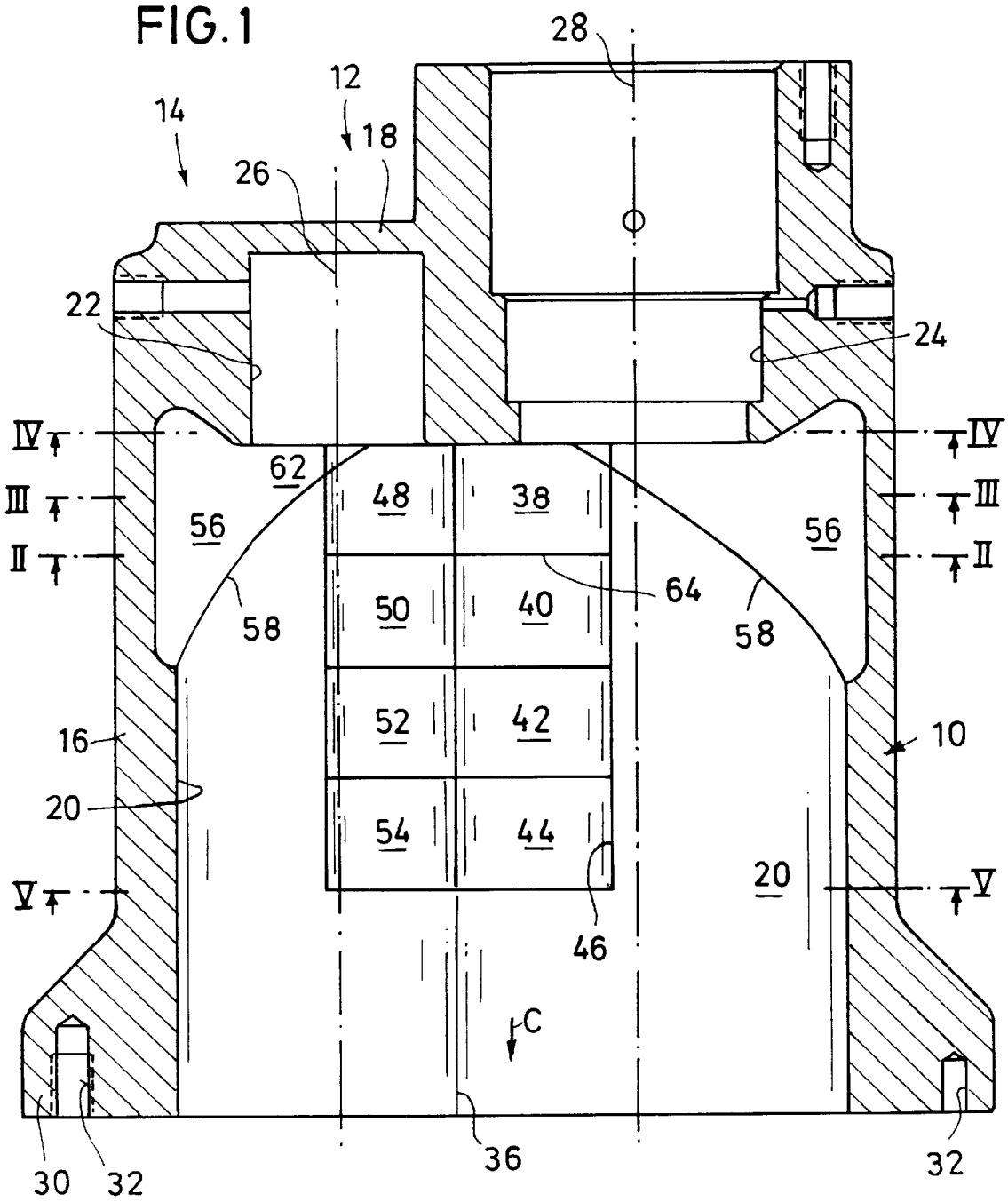
FIG. 1 is a sectional view of a housing of a first embodiment of the screw-type compressor, the section being defined by the rotor axes of a primary and a secondary rotor.

FIG. 1 shows a housing shell 10 of a housing 12 of a first embodiment of the present screw-type compressor 14. The housing shell 10 has a substantially cylindrical circumferential wall 16 enclosing, in cross section, two parallel overlapping circular cylinders, the wall being provided at the intake end of the screw-type compressor 14 with a housing cover 18 integrally molded with the circumferential wall 16. The housing shell 10 has a inner housing wall 20, the shape of which follows the envelope of two rotors to be installed in the housing 12. The rotors, not illustrated in the FIGS. 1–7, are each supported in the housing at the intake side by means of a respective plain bearing located in bearing recesses 22, 24 of the housing cover 18. When mounted, the rotors take a fitting position represented in the drawings by the position of the longitudinal axes 26, 28 of the primary and secondary rotors.

At the pressure side end averted from the housing cover 18, the housing shell has a flange 30 provided with threaded bores 32 that allow the fixing of the housing shell 10 at a pressure side connector block (not illustrated). The connector block may also be designed as the connector block of a twin screw compressor having a total of four rotors.

The housing shell 10 that is pot-shaped to receive the primary and secondary rotors, has its bottom provided with a base 34 extending in parallel to the longitudinal axis 26 of the primary rotor and the longitudinal axis 28 of the secondary rotor.

To generate compressed gas in the screw-type compressor 14, the tooth flanks of the non-illustrated rotors together with the inner housing wall 20 form compression chambers, respectively. Since the inner housing wall 20 follows the course of the envelope along the section line of two cylinders of the rotors, two sealing edges 36 are formed between the rotors, extending in the longitudinal direction thereof (FIG. 2).

At the bottom of the housing shell 10 facing the base 34, housing segments 38, 40, 42, 44 are arranged in a well 46 in the vicinity of the base 34. The rotor-side top faces 48, 50, 52, 54 of the housing segments 38, 40, 42, 44, shown in top plan view in FIG. 1, have a shape that imitates the course of the envelope of the rotors (FIG. 2) so that the inner housing wall 20, together with the top faces 48, 50, 52, 54 of the housing segments 38, 40, 42, 44, in a sealing manner circumferentially encloses two meshing rotors outside their contact area. Only at the intake end of the housing shell 10, an annular groove 56 extending throughout the interior of the housing is provided (FIG. 4), the inner cross section of which is wider than the diameter of the envelope of the rotors. The annular groove 56 extends only over about a quarter of the length of the rotors and has a control edge 58 beneath the rotors that delimits the region of the inner wall enclosing the rotors in a sealing manner from the annular groove 56. When the tooth head of a rotor tooth has passed the control edge 58, there is a sealing between the inner housing wall 20 and the respective tooth flanks so that a return flow of pressure gas is prevented.

Figure 2:
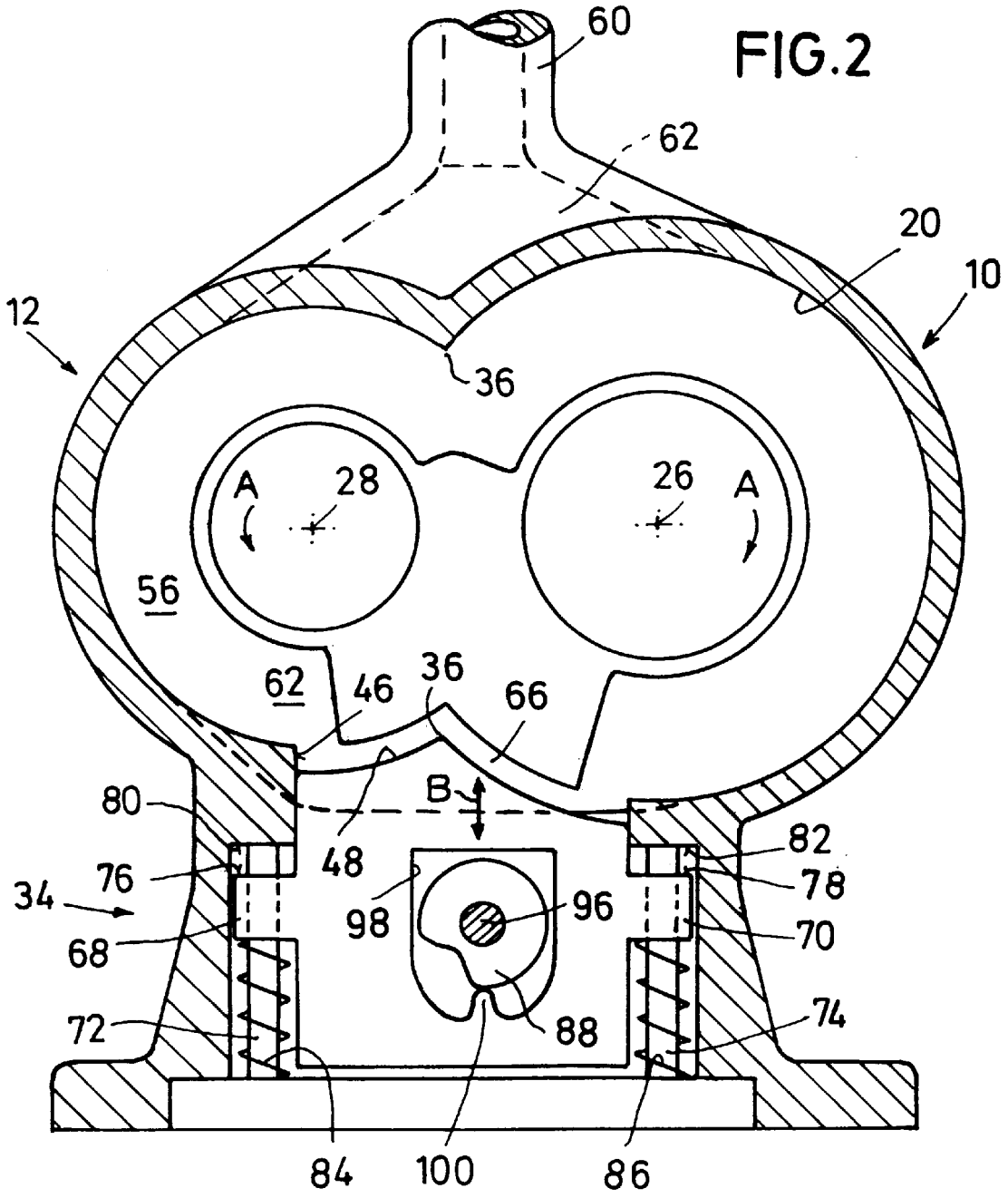
FIG. 2 illustrates a section through the housing in FIG. 1 taken along line II—II in FIG. 1.
Figure 3:
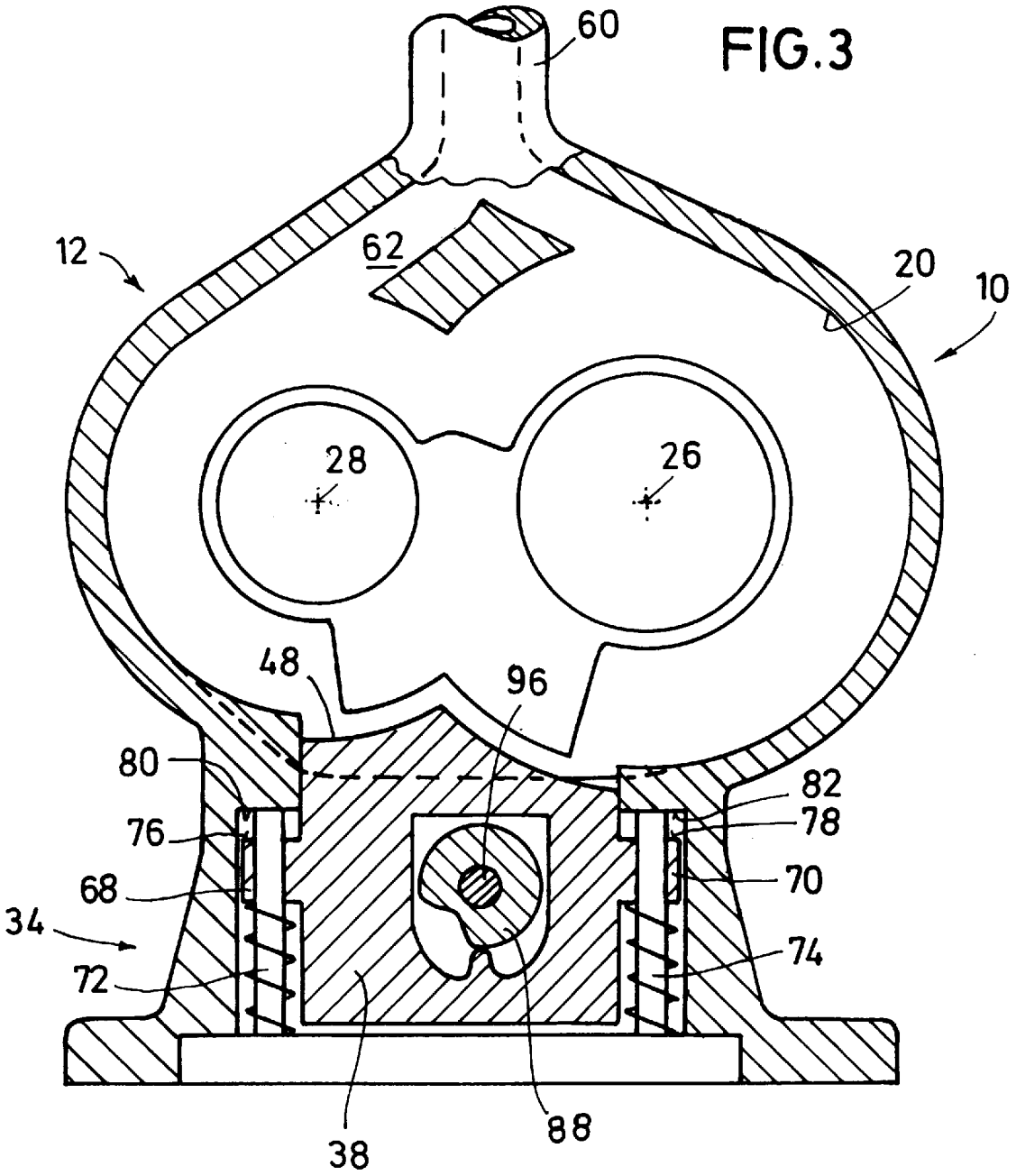
FIG. 3 illustrates a section through the housing in FIG. 1 taken along the line III—III in FIG. 1.
Figure 4:
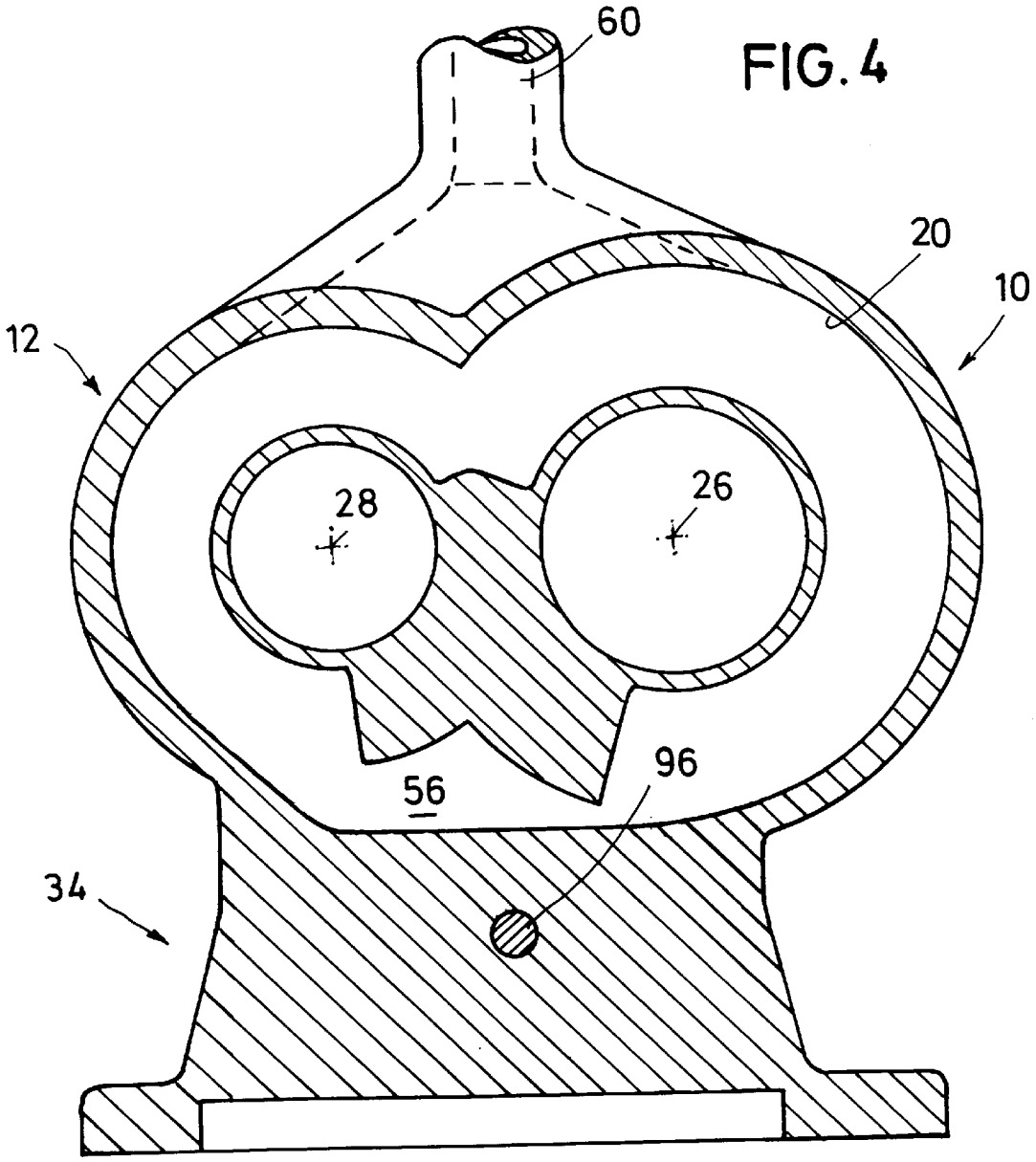
FIG. 4 illustrates a section through the housing in FIG. 1 taken along the line IV—IV in FIG. 1.

In the screw-type compressor 14 illustrated, the housing segments 38, 40, 42, 44 may be displaced within the well 46 in the direction of the double arrow B (FIG. 2). When all housing segments 38, 40, 42, 44 are in their upper end position (FIG. 5), a feed channel with an inlet socket 60 and the annular groove 56 from an inlet channel 62 (FIG. 2) that provides for air supply to the rotors. When all housing segments 38, 40, 42, 44 are in their upper end positions, the compression starts as soon as a tooth of a rotor passes the control edge 58. If, however, one housing segment, e,g, the housing segment 38, is lowered (FIG. 2), compression is started only when a tooth has passed the edge 64 of the housing segment 38, since in the lowered state, the inlet channel 62 is formed, downstream of the annular groove 56, also with a return flow channel 66 formed between the rotors and the top face 48 of the housing segment 38.

When all housing segments 38, 40, 42, 44 are in their upper end positions, the screw-type compressor operates at its structurally defined maximum internal compression ratio (internal pressure ratio). If, however, the first housing segment 38 is lowered completely, this reduces the internal compression ratio by 15%. If the housing segments 40, 42 and 44 are lowered successively, thereby extending the inlet channel 62, the internal compression ratio and, thus, the displacement are reduced correspondingly.

The housing segments 38, 40, 42, 44 are each plate-like bodies with guiding blocks 68, 70 at their small faces, which each enclose a guiding cylinder 72, 74 fixedly arranged at the housing, the blocks being slidably supported at the cylinder. The guiding blocks 68, 70 each have a top stop surface 76, 78 with which the housing segment abuts against abutment surfaces 80, 82 of the housing 12 when in the upper end position. The abutment surfaces 80, 82 each extend in the direction of the rotor axes over the width of the four housing segments 38, 40, 42, 44. Each housing segment 38, 40, 42, 44 of the first embodiment is pushed to the respective top end position by a first and second spiral spring 84, 86, each arranged enclosing the respective guiding cylinder 72, 74.

Figure 5:
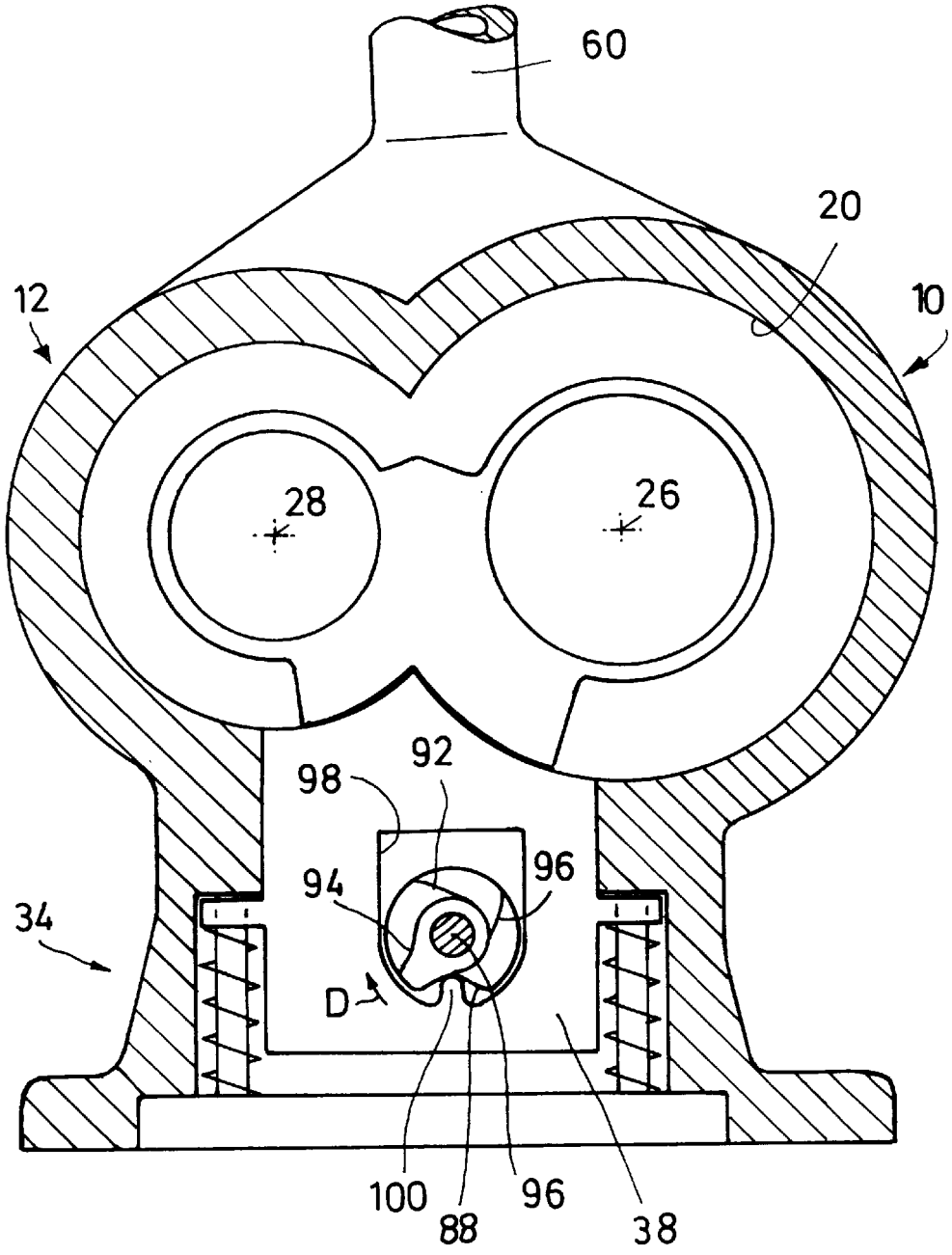
FIG. 5 illustrates a section through the housing in FIG. 1 taken along the line V—V in FIG. 1.

To move the housing segments 38, 40, 42, 44, a cam shaft 96 with control cams 88, 90, 92, 94 is provided that extends in parallel to the longitudinal axis of the primary and secondary rotors 26, 28 and may be rotated by means of a stepper motor to displace the housing segments 38, 40, 42, 44 into their open position, as indicated by the arrow D in FIG. 5. To make it possible for the control cams 88, 90, 92, 94 to apply force at the housing segments 38, 40, 42, 44, the housing segments 38, 40, 42, 44 each have a recess 98 into which a control pin 100 contacting the respective control cam 88, 90, 92, 94 projects. The control pin 100 is arranged on the side of the recess 98 of each housing segment 38, 40, 42, 44 that is remote from the rotors so that a rotation of the cam shaft 96, while a control pin contacts a control cam 88, 90, 92, 94, causes a displacement of the respective housing segment 38, 40, 42, 44 against the bias of the respective first and second spiral spring 72, 74.

Figure 6:
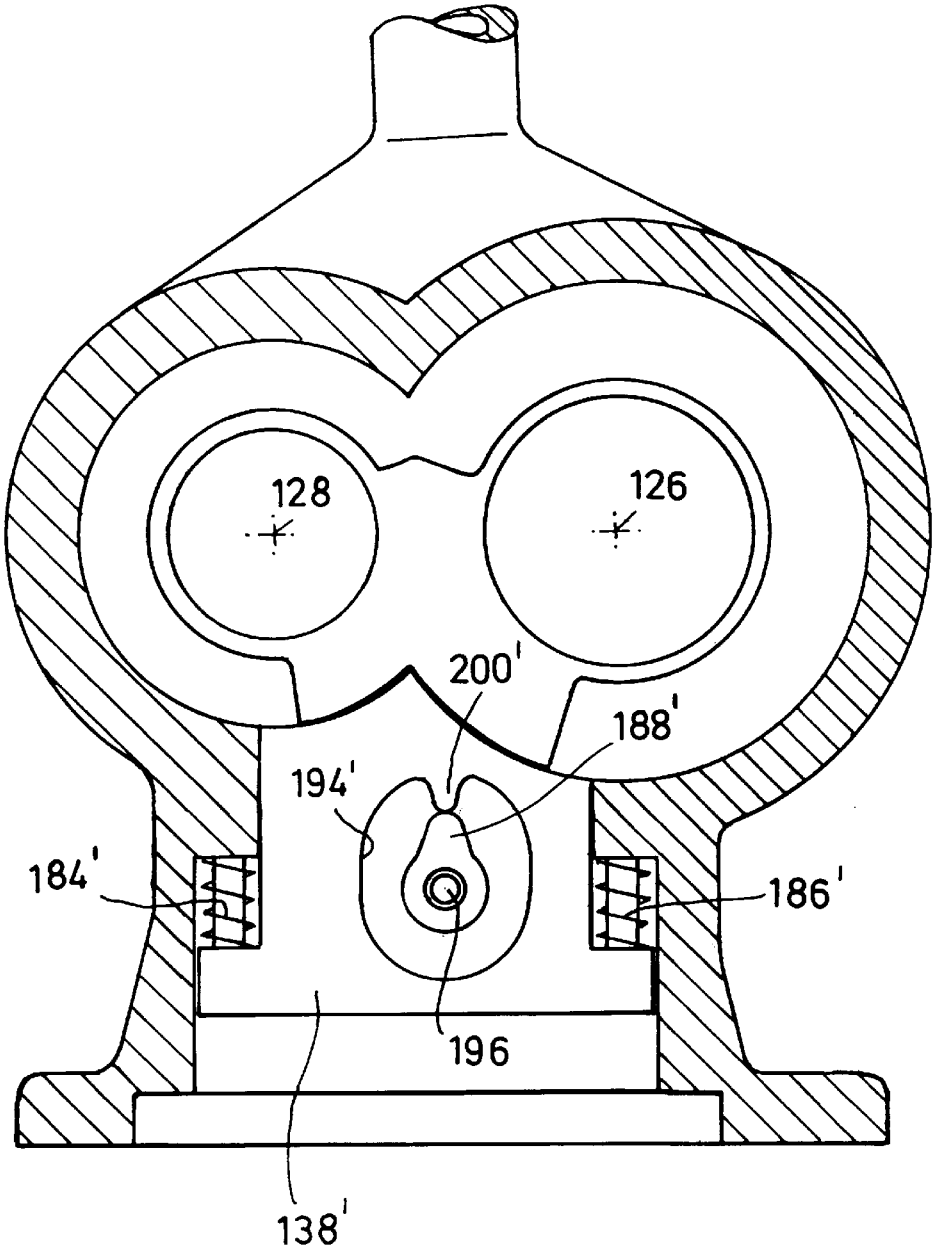
FIG. 6 illustrates a section through a housing according to a second embodiment of a screw-type compressor corresponding to the sectional view of FIG. 2.
Figure 7:
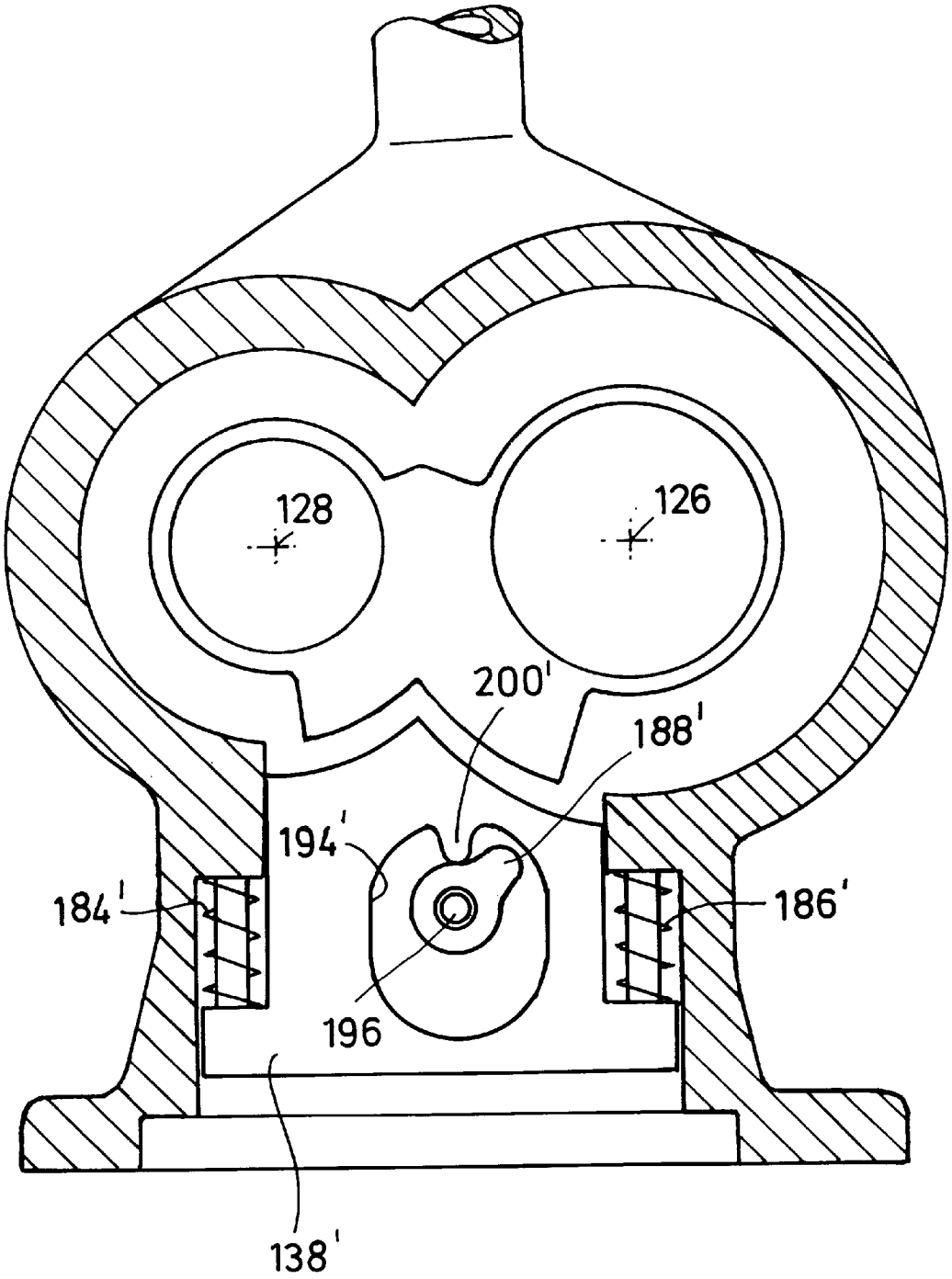
FIG. 7 illustrates the housing of FIG. 6 with a housing segment displaced with respect to the state shown in FIG. 6 by rotation of a cam shaft.

The embodiment shown in FIGS. 6 and 7 differs from the embodiment illustrated in the FIGS. 1 to 5 only by the structure of the actuating means for the housing segments. For reasons of simplicity, the description of FIGS. 6 and 7 uses reference numerals incremented by 100 with respect to the reference numerals used for the first embodiment. To avoid repetitions, reference is made to the description of the corresponding parts in the first embodiment.

Whereas in the first embodiment, the first and second spiral springs 84, 86 push the housing segments into their closing position, corresponding first and second spiral springs 184', 186' of the second embodiment push the respective housing segment 138' into its opening position. Accordingly, the control cams 188 of the second embodiment are closing cams in contrast to the first embodiment, the cams releasing a control pin provided in a recess 198' of a respective housing segment 138' upon rotation of the cam shaft 196 such that the corresponding housing segment is displaced into its opening position illustrated in FIG. 6.

Although a preferred embodiment of the invention has been specifically illustrated and described herein, it is to be understood that minor variations may be made in the apparatus without departing from the spirit and scope of the invention, as defined the appended claims.

I claim:

1. A variable displacement screw-type compressor comprising at least one primary rotor and at least one secondary rotor arranged in a common housing (12), said primary and secondary rotors being in mesh with each other for conveying a medium under compression from an inlet channel (62) to an outlet channel, the inlet channel (62) being delimited by at least one housing segment (38, 40, 42, 44) slidable in the housing (12), a sealing side of the segment facing the rotors and following a flow envelope defined by the rotors, said at least one housing segment (38, 40, 42, 44) being guided and slidable in a well (46) disposed transverse to axes (26, 28) of said rotors, the housing segment (38, 40, 42, 44) being biased by a spring (84, 86), and a control cam (88, 90, 92, 94) being provided for displacing the housing segment (38, 40, 42, 44) against the bias of the spring (84, 86).

2. The screw-type compressor as defined in claim 1, wherein each housing segment has two stop surfaces (76, 76) limiting the movement of each housing segment (38, 40, 42, 44) towards the rotors.

3. The screw-type compressor as defined in claim 1, wherein the housing is provided with two abutment surfaces (80, 82) extending vertically relative to a displacement direction (B) of the housing segment (38, 40, 42, 44).

4. The screw-type compressor as defined in claim 1, including a plurality of control cams (88, 90, 92, 94) for a plurality of housing segments arranged on a common cam shaft (96).

5. The screw-type compressor as defined in claim 1, wherein each control cam (88, 90, 92, 94) presses a housing segment (38, 40, 42, 44) into an open position against the bias of a spring (84, 86).

6. The screw-type compressor as defined in claim 1, wherein each housing segment (38, 40, 42, 44) has a length in the axial direction of the rotors that corresponds to the distance between two contact points of two meshing pairs of teeth of said rotors.

7. The screw-type compressor as defined in claim 6, wherein at least two housing segments (38, 40, 42, 44) are arranged successively and adjoining in the axial direction of the rotors.

8. The screw-type compressor as defined in claim 7, wherein the housing is provided with two abutment surfaces (80, 82) extending vertically relative to a displacement direction (B) of the housing segment (38, 40, 42, 44).

9. The screw-type compressor as defined in claim 6, wherein each housing segment has two stop surfaces (76, 76) limiting the movement of each housing segment (38, 40, 42, 44) towards the rotors.

10. The screw-type compressor as defined in claim 6 wherein the housing is provided with two abutment surfaces (80, 82) extending vertically relative to a displacement direction (B) of the housing segment (38, 40, 42, 44).

11. The screw-type compressor as defined in claim 1, wherein at least two housing segments (38, 40, 42, 44) are arranged successively and adjoining in the axial direction of the rotors.

12. The screw-type compressor as defined in claim 11 wherein each housing segment has two stop surfaces (76, 76) limiting the movement of the housing segment (38, 40, 42, 44) towards the rotors.

13. The screw-type compressor as defined in claim 11, wherein the housing is provided with two abutment surfaces (80, 82) extending vertically relative to a displacement direction (B) of the housing segment (38, 40, 42, 44).

* * * * *